US005776215A

United States Patent [19]

Amoretti

[11] Patent Number: 5,776,215

[45] Date of Patent: Jul. 7, 1998

[54] MACHINE FOR HOUSEHOLD CLEANING

[75] Inventor: Andrea Amoretti, Romano D'Ezzelino, Italy

[73] Assignee: T.P.A. Impex S.p.A., Romano D'Ezzelino, Italy

[21] Appl. No.: 729,888

[22] Filed: Oct. 11, 1996

[30] Foreign Application Priority Data

Oct. 13, 1995 [IT] Italy ..... PD95A0189
Jul. 12, 1996 [IT] Italy ..... PD96A0178

[51] Int. Cl.[6] ..... B01D 47/02; B01D 47/06

[52] U.S. Cl. ..... 55/223; 15/352; 55/226; 55/244; 55/249; 55/DIG. 3

[58] Field of Search ..... 55/223, 224, 226, 55/244, 249, DIG. 3; 95/226, 149; 15/347, 352

[56] References Cited

U.S. PATENT DOCUMENTS 941,676 11/1909 Green ..... 55/249
1,363,859 12/1920 Fetters et al. ..... 55/249
2,102,353 12/1937 Brock ..... 55/249
2,184,731 12/1939 Brewer ..... 55/249
3,778,978 12/1973 Matsushita ..... 55/249
4,251,241 2/1981 Bothun ..... 55/DIG. 3
4,874,404 10/1989 Boswell ..... 55/244
5,199,963 4/1993 Scarp ..... 55/DIG. 3

FOREIGN PATENT DOCUMENTS 740224 6/1980 U.S.S.R. ..... 55/249

*Primary Examiner*—Duane S. Smith
*Attorney, Agent, or Firm*—Guido Modiano; Albert Josif

[57] ABSTRACT

An improved machine for household cleaning which has, in a box-like body, a vacuum-cleaner section composed of a fan that is coupled to an electric motor, the intake of the fan being connected to a dirt suction duct. In the vacuum-cleaner section, upstream of the fan, the discharge of the fan generates a secondary air stream, separate from a main stream that contains dirt, in at least one Venturi duct that draws water from a water container and ends in a region where the main air stream passes, so as to wet and remove the dirt contained in the main stream.

19 Claims, 3 Drawing Sheets

MACHINE FOR HOUSEHOLD CLEANING

BACKGROUND OF THE INVENTION

The present invention relates to an improved machine for household cleaning.

More particularly, the invention relates to vacuum-cleaners or to machines with a vacuum-cleaner section combined with other sections, for example with a section for steam cleaning.

Conventional vacuum cleaners are substantially composed, inside a box-like body, of a fan that is coupled to an electric motor with the intake connected to a dirt suction duct.

In particular, the dirt suction duct leads into a filter bag of finely perforated paper that is in turn arranged in a seat connected to the intake of the fan.

Therefore, the air passes through the perforations of the bag and the dust is retained inside the bag.

Other embodiments, with filters of other kinds, are known which are based on the same principle.

The main problem that occurs in these vacuum cleaners resides in the fact that effectiveness in aspirating dirt decreases as said filter bag fills and as the holes of the paper become clogged.

Another drawback that occurs is due to the fact that the filter bag is in any case unable to retain one hundred per cent of the aspirated dust.

Vacuum cleaners using water as a means to remove the dirt contained in the suction air stream have recently been devised to solve these drawbacks.

In practice, a fan that rotates at very high speed is arranged, with an appropriate separator, above a water container in which the suction duct ends.

The fan, by turning, causes a turbulent motion in the air inside the container and shakes and stirs the water while aspirating through the suction duct.

The dirty air thus flows into the container and enters the water and the dirt particles become wet and are collected.

With respect to conventional vacuum cleaners, the suction power remains unchanged over time, since there are no filters or filter bags, efficiency is high, and running costs are lower.

However, there is a high manufacturing cost, caused by the need for a fan that rotates at very high speed and by the presence of water and therefore of gaskets, protections, etcetera.

Furthermore, the motor of the fan is necessarily located in the upper part of the water container and is therefore subjected to continuous humidity, with consequent problems in durability, and is particularly close to the dirt.

Furthermore, from the point of view of user safety, it should be noted that in order to access the container it is necessary to remove the motor (obviously after disconnecting the power cord from the mains) and then extract the container from the body.

The motor, with the associated fan, is dirty and wet in the region that faces the container, and this causes problems to the user, who must generally rest it on regions that have just been cleaned.

Another recent type of vacuum cleaner has a water container that is not associated with the motor and a suction duct for the stream of dirty air in which a branch is provided that draws water from said water container by virtue of the Venturi effect.

Therefore, the water, aspirated together with the dirty air, wets the particles and removes them inside the container.

Accordingly, the water is aspirated by the pressure reduction, and the amount of said water that flows inside the suction duct is directly proportional to the efficiency in removing the dirt particles and depends on the pressure reduction that is produced inside the suction duct.

This limits the system from the operational point of view, since it is not possible to independently regulate the amount of water that is fed into the suction duct.

SUMMARY OF THE INVENTION

A principal aim of the present invention is to provide an improved machine for household cleaning with a vacuum-cleaner section that eliminates the above-mentioned drawbacks of conventional machines.

Within the scope of the above aim, a consequent primary object is to provide a machine with a vacuum-cleaner section that removes dirt by means of water but allows to regulate the amount of water for dirt removal independently of the air stream that draws up the dirt.

Another important object is to provide a machine having a vacuum-cleaner section in which the container of the water for dirt removal is separate from the aspiration motor unit and is therefore easier and more practical to maintain for the user.

Another important object is to provide a machine having a vacuum-cleaner section that is constructively simpler and therefore less expensive than current ones.

This aim, these objects, and others that will become apparent hereinafter are achieved by an improved machine for household cleaning comprising, in a box-like body, a vacuum-cleaner section composed of a fan that is coupled to an electric motor, the intake of the fan being connected to a dirt suction duct, characterized in that means are provided in said body, upstream of said fan, which generate a secondary air stream, separate from a main stream that contains dirt, in at least one Venturi duct that draws water from a water container and ends in a region where said main stream of air passes, so as to wet and remove the dirt contained in said main stream.

BRIEF DESCRIPTION OF THE DRAWINGS

Further characteristics and advantages of the invention will become apparent from the following detailed description of two embodiments thereof, illustrated only by way of non-limitative example in the accompanying drawings, wherein.

DESCRIPTION OF THE PREFERRED EMBODIMENTS

Figure 1:
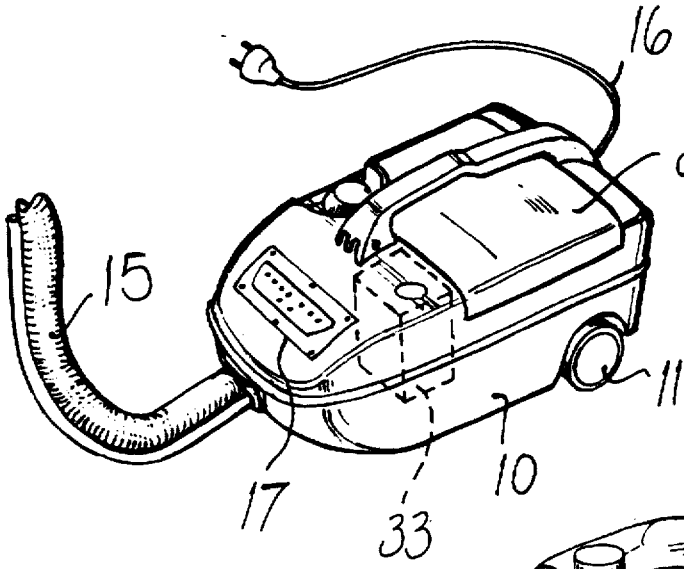
FIG. 1 is a perspective view of a vacuum cleaner.
Figure 2:
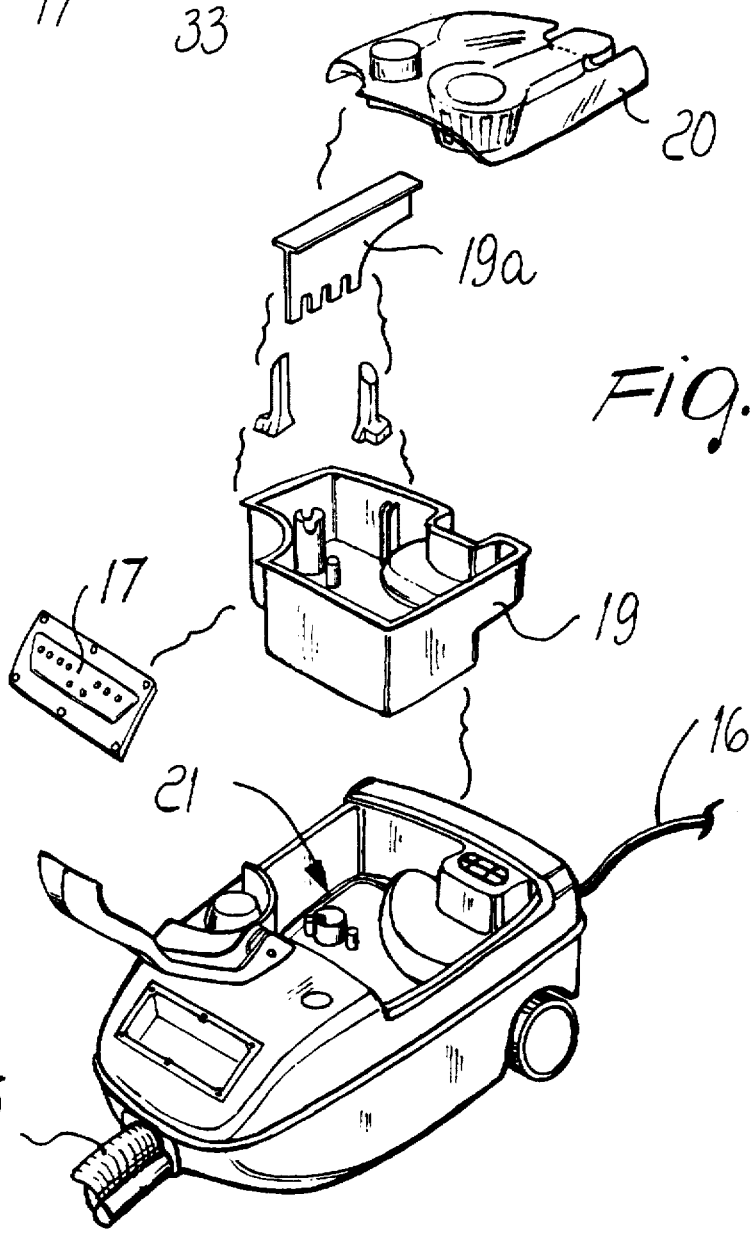
FIG. 2 is a perspective view of the machine of FIG. 1, with the container and the dirt collecting cover in a raised position.
Figure 3:
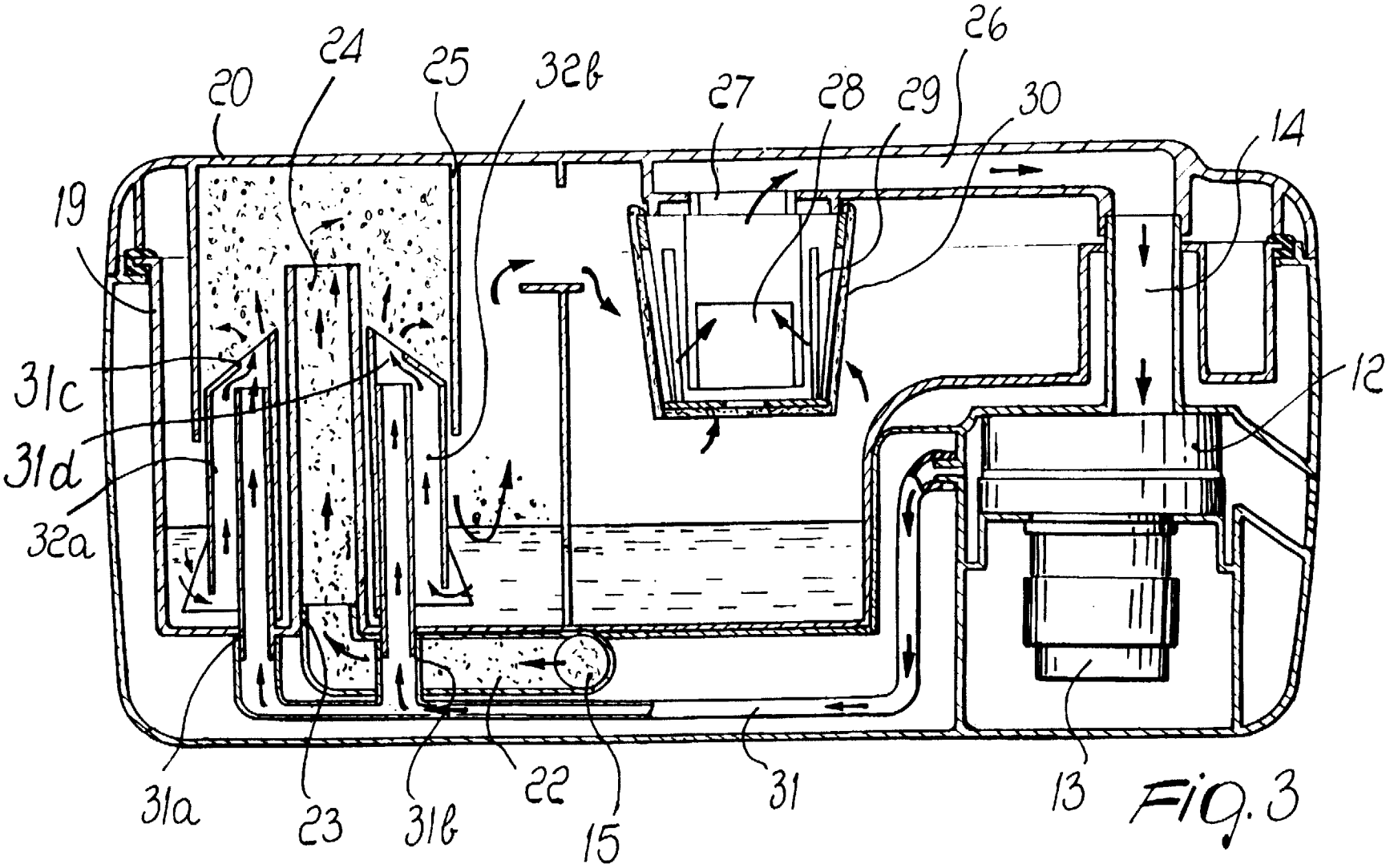
FIG. 3 is a schematic sectional view of the machine.

With reference to the above FIGS. 1 to 3, an improved machine for household cleaning, according to the invention, comprises a box-like body 10 with wheels 11 in which a "vacuum-cleaner" section contains a fan 12 that is coupled to an electric motor 13.

The intake of the fan 12 is connected to a dirt suction duct 14, the end portion 15 whereof is constituted by a flexible hose that is shown partially in the figures and can be held by the user.

As shown in FIGS. 1 and 2, the machine is conveniently provided with an electric power cord 16 and with a control panel 17 with buttons and monitoring indicators.

According to the invention, the dirty air aspirated by the end portion 15 of the suction duct 14 is conveyed into a water container 19 that is conveniently closed hermetically by a cover 20 and, together with said cover, is accommodated in an adapted compartment 21 of the box-like body 10 (FIG. 2).

More particularly, the end portion 15 is connected to a first portion 22 that is rigidly coupled to the body 10 and has a vertical coupling 23 that mates with a second vertical portion 24 that is monolithic with the container 19 and ends inside a dome 25 that extends downwards from the cover 20, with which it is monolithic.

The intake of the fan 12 instead mates with a third portion 26 that is formed in the cover 20 and ends inside the container 19 with a vertical coupling 27 interrupted by a floater 28, which is retained downward by a grilled cup-shaped element 29 that can be externally provided with a filtering sponge 30.

The closure level of the floater 28 is conveniently lower than the outlet of the vertical portion 24.

Accordingly, the main stream of air is forced to pass inside the container 19 before flowing through the fan 12.

A removable vertical partition 19*a* is arranged between the grilled cup-shaped element 29 and the dome 25 in the container 19 and is adapted to increase the convolution of the path of the air and optimize removal.

Also according to the invention, the body 10 contains means that generate a secondary air stream and are constituted, in this case, directly by the fan 12, particularly by its discharge, which is connected, by means of the branches 31*a* and 31*b* of a tube 31 that are fitted on ends 31*c* and 31*d* arranged vertically inside the container 19, to two Venturi ducts 32*a* and 32*b* arranged in said container 19 so as to lie diametrically opposite to the second portion 24 relating to the main stream.

As shown in particular in FIG. 3, the ducts 32*a* and 32*b* draw water from the container 19 and end at the upper outlet of the second portion 24 of the main stream.

The water aspirated by Venturi effect by the secondary air stream then encounters the main stream of air in the dome 25 and wets and removes the dirt contained therein, which deposits on the bottom of the container 19.

It is also possible to provide, at the outlet of the Venturi ducts 32*a* and 32*b*, nozzles that nebulize the aspirated water and are not shown in the figures.

The machine also comprises, within the box-like body 10, a steam section of a per se known type that is shown in dashed lines in FIG. 1 and generally designated by the reference numeral 33.

Figure 4:
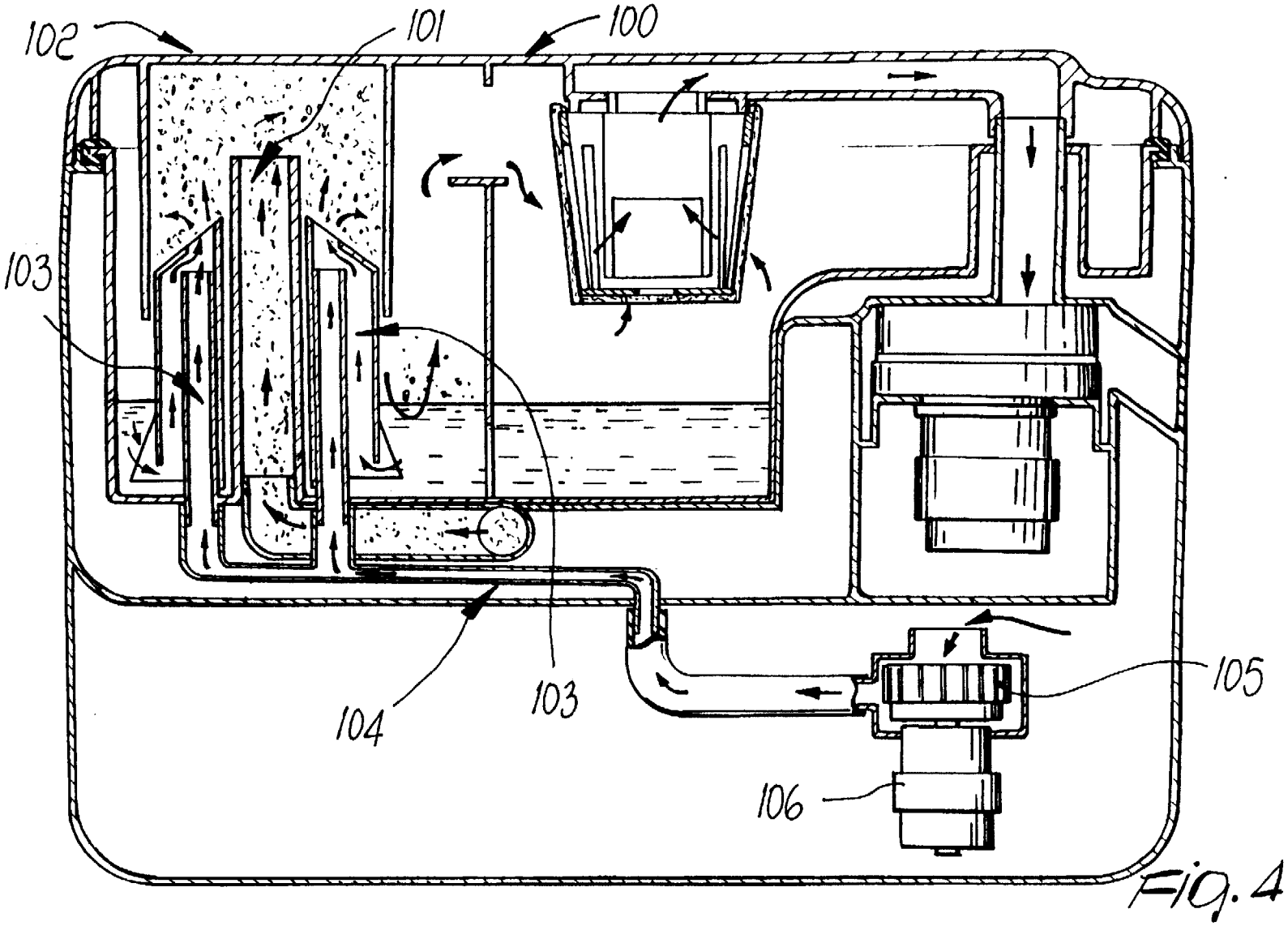
FIG. 4 is a schematic sectional view of a second embodiment of the part meant to remove the dirt.

With reference now to the above-mentioned FIG. 4, in another embodiment of the invention there is again a water container, now designated by the reference numeral 100, with a vertical portion of the dirty air stream 101 and a dome 102.

Venturi ducts 103 and a tube 104 are again present to the side of the duct 101 and convey the secondary air stream produced in this case by a secondary fan 105 that is separate from the primary one and is coupled to an electric motor 106 of its own.

Operation is the same as in the previous embodiment, with the further possibility of regulating the secondary air stream independently of the main one.

In practice it has been observed that the intended aim and objects of the present invention have been achieved.

In fact, with respect to conventional machines that aspirate water from the container and make said water encounter the main flow of dirty air, the Venturi effect has been made independent of the dynamic conditions of the main flow.

The unit is constructively simple, and as regards maintenance, one merely has to lift the cover and the container out of the box-like body.

This can be done even without disconnecting the electric power supply, since the parts containing water are fully separate from the electrical parts.

The invention thus conceived is susceptible of numerous modifications and variations, all of which are within the scope of the inventive concept.

Thus, for example, there may also be more than two Venturi ducts, according to operating requirements.

All the details may furthermore be replaced with other technically equivalent elements.

In practice, the materials employed, so long as they are compatible with the contingent use, as well as the dimensions, may be any according to the requirements.

What is claimed is:

1. A machine for household cleaning comprising:

a box shaped body including a vacuum-cleaner section;

a fan for generating a main air stream; an electric motor coupled to said fan, the fan and the electric motor being located in said vacuum-cleaner section;

a hermetically closed water container;

a dirt suction duct, being connected to an intake of said fan, and having and end portion with an outlet thereof located in said water container;

at least one Venturi duct, for aspirating water from the water container, which ends in a region where said main air stream passes so as to wet and remove the dirt contained in said main stream;

air generating means, provided in said body upstream of said fan, for generating a secondary air stream, in said at least one Venturi duct, which is separate from the main stream that contains dirt;

an upper duct portion, connected to the intake of the fan, and ending downwardly at the internal upper part of said water container, with a vertical coupling thereof;

a floater for interrupting said vertical coupling; and a grilled containment element for retaining said floater, with said floater having a closure level being lower than the outlet of said end portion that lies inside said container.

2. The machine according to claim 1, wherein said air generating means for generating a secondary air stream is constituted by a discharge of said fan.

3. The machine according to claim 1, wherein said air generating means for generating a secondary air stream is constituted by a secondary fan that is separate from the fan for generating the main air stream, and wherein a further electric motor is provided coupled to said secondary fan.

4. The machine according to claim 1, wherein said water container is closed hermetically by a cover and is accommodated, together with said cover, in an adapted compartment of said box shaped body.

5. The machine according to claim 4, wherein said end portion of said suction duct is vertical, is arranged in said water container, and ends with the outlet thereof inside a dome protruding downwardly from said cover.

6. A machine according to claim 5, wherein a removable partition is arranged between said dome and said grilled containment element in said water container, said partition being adapted to increase air flow convolution inside said water container.

7. The machine according to claim 1, wherein said air generating means for generating a secondary air stream are connected, through tube branches, to said at least one Venturi duct which is provided in said water container to a side of the outlet of the end portion of the dirt suction duct.

8. The machine of claim 7, wherein two Venturi tubes are provided, arranged diametrically opposite with respect to said end portion of the dirt suction duct.

9. The machine according to claim 8, comprising, at outlets of said Venturi ducts, nozzles for nebulizing the aspirated water.

10. The machine of claim 1, further comprising, located in said box shaped body, a steam section.

11. A machine for household cleaning comprising:

a box shaped body including a vacuum-cleaner section;

a fan for generating a main air stream; an electric motor coupled to said fan, the fan and the electric motor being located in said vacuum-cleaner section;

a water container hermetically closed by a cover;

a dirt suction duct, being connected to an intake of said fan, and having and end portion with an outlet thereof located in said water container inside a dome protruding downwardly from said cover;

at least one Venturi duct, for aspirating water from the water container, which ends in a region where said main air stream passes so as to wet and remove the dirt contained in said main stream;

air generating means, provided in said body upstream of said fan, for generating a secondary air stream, in said at least one Venturi duct, which is separate from the main stream that contains dirt;

an upper duct portion, connected to the intake of the fan, and ending downwardly at the internal upper part of said water container, with a vertical coupling thereof;

a floater for interrupting said vertical coupling;

a grilled containment element for retaining said floater, with said floater having a closure level being lower than the outlet of said end portion that lies inside said container; and a removable partition being arranged between said dome and said grilled containment element to increase air flow convolution inside said water container.

12. The machine according to claim 11, wherein said air generating means for generating a secondary air stream is constituted by a discharge of said fan.

13. The machine according to claim 11, wherein said air generating means for generating a secondary air stream is constituted by a secondary fan that is separate from the fan for generating the main air stream, and wherein a further electric motor is provided coupled to said secondary fan.

14. The machine according to claim 11, wherein said water container closed hermetically by the cover is accommodated in an adapted compartment of said box shaped body.

15. The machine according to claim 11, wherein said end portion of said suction duct is vertical.

16. The machine according to claim 12, wherein said air generating means for generating a secondary air stream are connected, through tube branches, to said at least one Venturi duct which is provided in said water container to a side of the outlet of the end portion of the dirt suction duct.

17. The machine of claim 16, wherein two Venturi tubes are provided, arranged diametrically opposite with respect to said end portion of the dirt suction duct.

18. The machine according to claim 11, comprising, at outlets of said Venturi ducts, nozzles for nebulizing the aspirated water.

19. The machine of claim 11, further comprising, located in said box shaped body a steam section.

* * * * *